US008429829B2

(12) United States Patent
Arnold

(10) Patent No.: US 8,429,829 B2
(45) Date of Patent: Apr. 30, 2013

(54) MEASURING DEVICE

(75) Inventor: Yan Arnold, Marin (CH)

(73) Assignee: HOMMEL-ETAMIC GmbH, Villingen-Schwenningen (DE)

( * ) Notice: Subject to any disclaimer, the term of this patent is extended or adjusted under 35 U.S.C. 154(b) by 72 days.

(21) Appl. No.: 13/073,625

(22) Filed: Mar. 28, 2011

(65) Prior Publication Data

US 2011/0232117 A1 Sep. 29, 2011

(30) Foreign Application Priority Data

Mar. 26, 2010 (DE) ..... 10 2010 013 069

(51) Int. Cl.
*G01B 3/38* (2006.01)

(52) U.S. Cl.
USPC ..... 33/555.1

(58) Field of Classification Search ..... 33/201, 33/549, 550, 555.1, 556
See application file for complete search history.

(56) References Cited

U.S. PATENT DOCUMENTS

| | | | | |
|---|---|---|---|---|
| 1,425,283 | A | 8/1922 | Pratt | |
| 1,557,903 | A | 10/1925 | Tomberg | |
| 1,815,049 | A | 7/1931 | Cole | |
| 1,892,005 | A | 12/1932 | Richmond | |
| 1,941,456 | A * | 1/1934 | Arnold | 33/556 |
| 2,408,672 | A | 10/1946 | Mennesson | |
| 2,603,043 | A | 7/1952 | Bontemps | |
| 2,789,354 | A | 4/1957 | Polidor et al. | |
| 2,909,873 | A | 4/1957 | Fisk | |
| 2,949,708 | A | 8/1960 | Butterworth et al. | |
| 3,157,971 | A | 11/1964 | Snyder | |
| 3,352,022 | A | 10/1965 | Fisk | |
| 3,274,693 | A | 9/1966 | Witzke | |
| 3,321,869 | A | 5/1967 | Parrella et al. | |
| 3,352,065 | A | 11/1967 | Enkelmann | |
| 3,386,178 | A | 6/1968 | Arnold et al. | |
| 3,603,044 | A | 9/1971 | Price | |
| 3,648,377 | A | 3/1972 | Witzke | |
| 3,663,190 | A | 5/1972 | Fisk | |
| 3,688,411 | A | 9/1972 | Asano et al. | |
| 3,694,970 | A | 10/1972 | Schoonover et al. | |
| 3,777,441 | A | 12/1973 | Kurimoto et al. | |

(Continued)

FOREIGN PATENT DOCUMENTS

| | | |
|---|---|---|
| DD | 88446 | 3/1972 |
| DE | 2 146 360 | 3/1972 |

(Continued)

OTHER PUBLICATIONS

U.S. Appl. No. 12/923,412, dated Sep. 2010, Arnold.

(Continued)

*Primary Examiner* — G. Bradley Bennett
(74) *Attorney, Agent, or Firm* — Shlesinger, Arkwright & Garvey LLP

(57) ABSTRACT

A measuring device includes a base body, and a measuring head which is movable between a rest position and a measuring position. The measuring device also includes an apparatus for moving the measuring head from the rest position into the measuring position, and a stop for limiting the motion of the measuring head from the rest position into the measuring position. A motorized drive unit for adjusting the position of the stop is operatively associated with the stop in such a way that the measuring position is adjustable, and a control unit is provided for activating the drive unit.

12 Claims, 9 Drawing Sheets

U.S. PATENT DOCUMENTS

| | | | | |
|---|---|---|---|---|
| 3,793,775 | A | 2/1974 | Ishikawa et al. | |
| 3,802,087 | A | 4/1974 | Raiteri | |
| 3,863,352 | A | 2/1975 | Peonski | |
| 3,987,552 | A | 10/1976 | Raiteri | |
| 4,106,241 | A | 8/1978 | Fisk | |
| 4,141,149 | A | 2/1979 | George et al. | |
| 4,175,462 | A | 11/1979 | Simon | |
| 4,176,461 | A | 12/1979 | Gebel et al. | 33/555.1 |
| 4,244,110 | A | 1/1981 | Fournier | 33/561 |
| 4,351,115 | A | 9/1982 | Possati | |
| 4,414,748 | A | 11/1983 | Gauler et al. | |
| 4,429,464 | A | 2/1984 | Burrus | |
| 4,437,239 | A | 3/1984 | Possati | |
| 4,480,412 | A | 11/1984 | Shank et al. | |
| 4,485,593 | A | 12/1984 | Munzing et al. | |
| 4,524,546 | A | 6/1985 | Hoover et al. | |
| 4,596,076 | A | 6/1986 | Sigg | |
| 4,606,130 | A | 8/1986 | Vetter | 33/501.03 |
| 4,625,413 | A | 12/1986 | Possati et al. | |
| 4,637,144 | A * | 1/1987 | Schemel | 33/550 |
| 4,651,438 | A | 3/1987 | Hutter et al. | |
| 4,679,331 | A | 7/1987 | Koontz | |
| 4,807,400 | A | 2/1989 | Corallo et al. | |
| 4,819,195 | A | 4/1989 | Bell et al. | |
| 4,903,413 | A | 2/1990 | Bellwood | |
| 4,958,442 | A | 9/1990 | Eckhardt | |
| 4,986,004 | A | 1/1991 | Hartmann et al. | |
| 5,021,650 | A | 6/1991 | Rieder et al. | |
| 5,054,205 | A | 10/1991 | Danielli | 33/555.1 |
| 5,058,325 | A | 10/1991 | Pineau | |
| 5,077,908 | A | 1/1992 | Moore | |
| 5,086,569 | A | 2/1992 | Possati et al. | |
| 5,088,207 | A | 2/1992 | Betsill et al. | |
| 5,095,634 | A | 3/1992 | Overlach et al. | |
| 5,097,602 | A | 3/1992 | Cross et al. | |
| 5,099,585 | A | 3/1992 | Liskow | |
| 5,123,173 | A | 6/1992 | Possati | |
| 5,136,527 | A | 8/1992 | Koretz | |
| 5,150,545 | A | 9/1992 | Esteve | 451/8 |
| 5,337,485 | A | 8/1994 | Chien | |
| 5,419,056 | A | 5/1995 | Breitenstein | |
| 5,479,096 | A | 12/1995 | Szczyrbak et al. | |
| 5,542,188 | A | 8/1996 | Ertl et al. | |
| 5,551,814 | A | 9/1996 | Hazama | |
| 5,551,906 | A | 9/1996 | Helgren | |
| 5,758,431 | A | 6/1998 | Golinelli | |
| 5,761,821 | A | 6/1998 | Laycock | 33/555.1 |
| 5,771,599 | A | 6/1998 | Uchimura et al. | |
| 5,902,925 | A | 5/1999 | Crispie et al. | |
| 5,914,593 | A | 6/1999 | Arms et al. | |
| 5,919,081 | A | 7/1999 | Hykes et al. | |
| 5,956,659 | A | 9/1999 | Spies et al. | |
| 5,982,501 | A | 11/1999 | Benz et al. | |
| 6,029,363 | A | 2/2000 | Masreliez et al. | |
| 6,062,948 | A | 5/2000 | Schiff et al. | |
| 6,067,721 | A | 5/2000 | Dall'Aglio et al. | 33/555.1 |
| 6,088,924 | A | 7/2000 | Esteve | 33/551 |
| 6,116,269 | A | 9/2000 | Maxson | |
| 6,159,074 | A | 12/2000 | Kube et al. | |
| 6,167,634 | B1 | 1/2001 | Pahk et al. | |
| 6,256,898 | B1 | 7/2001 | Trionfetti | |
| 6,266,570 | B1 | 7/2001 | Hocherl et al. | |
| 6,298,571 | B1 | 10/2001 | Dall'Aglio et al. | 33/555.1 |
| 6,304,827 | B1 | 10/2001 | Blixhavn et al. | |
| 6,321,171 | B1 | 11/2001 | Baker | |
| 6,415,200 | B1 | 7/2002 | Kato et al. | |
| 6,430,832 | B1 | 8/2002 | Dall'Aglio et al. | 33/555.1 |
| 6,487,787 | B1 | 12/2002 | Nahum et al. | |
| 6,487,896 | B1 | 12/2002 | Dall'Aglio | |
| 6,490,912 | B1 | 12/2002 | Volk | |
| 6,511,364 | B2 | 1/2003 | Ido et al. | |
| 6,560,890 | B1 | 5/2003 | Madge et al. | |
| 6,568,096 | B1 | 5/2003 | Svitkin et al. | |
| 6,643,943 | B2 * | 11/2003 | Dall'Aglio et al. | 33/555.3 |
| 6,645,047 | B1 | 11/2003 | Liskow | |
| 6,711,829 | B2 | 3/2004 | Sano et al. | |
| 6,848,190 | B2 | 2/2005 | Dall'Aglio et al. | 33/555.3 |
| 6,931,749 | B2 | 8/2005 | Dall'Aglio | 33/555.3 |
| 6,952,884 | B2 | 10/2005 | Danielli | 33/555.1 |
| 6,955,583 | B2 | 10/2005 | Dall'Aglio | 451/5 |
| 7,020,974 | B2 | 4/2006 | Danielli et al. | 33/555.3 |
| 7,024,785 | B2 * | 4/2006 | Dall'Aglio et al. | 33/555.3 |
| 7,047,658 | B2 | 5/2006 | Danielli et al. | 33/555.1 |
| 7,325,324 | B2 | 2/2008 | Dall'Aglio et al. | 33/555.3 |
| 7,464,482 | B2 | 12/2008 | Dall'Aglio et al. | 33/555.3 |
| 7,607,239 | B2 | 10/2009 | Dall'Aglio et al. | 33/555.1 |
| 7,665,222 | B2 | 2/2010 | Dall'Aglio | 33/558 |
| 7,690,127 | B2 | 4/2010 | Dall'Aglio et al. | 33/555.3 |
| 7,954,253 | B2 * | 6/2011 | Dall'Aglio et al. | 33/555.1 |
| 2002/0020075 | A1 | 2/2002 | Dall'Aglio et al. | 33/555.1 |
| 2002/0066179 | A1 | 6/2002 | Hall et al. | |
| 2002/0155790 | A1 | 10/2002 | Ido et al. | |
| 2002/0166252 | A1 | 11/2002 | Dall'Aglio et al. | 33/555.3 |
| 2003/0009895 | A1 | 1/2003 | Dall'Aglio | |
| 2003/0056386 | A1 | 3/2003 | Danielli et al. | 33/555.1 |
| 2004/0045181 | A1 | 3/2004 | Dall'Aglio et al. | 33/555.3 |
| 2004/0055172 | A1 * | 3/2004 | Danielli | 33/555.1 |
| 2004/0137824 | A1 | 7/2004 | Dall'Aglio | |
| 2005/0178018 | A1 | 8/2005 | Dall'Aglio et al. | 33/555.3 |
| 2005/0217130 | A1 | 10/2005 | Danielli et al. | 33/555.1 |
| 2007/0039196 | A1 | 2/2007 | Dall'Aglio et al. | 33/555.3 |
| 2008/0155848 | A1 | 7/2008 | Dall'Aglio et al. | 33/555.3 |
| 2009/0113736 | A1 | 5/2009 | Dall'Aglio et al. | 33/555.3 |
| 2010/0000109 | A1 * | 1/2010 | Dall'Aglio et al. | 33/555.1 |
| 2011/0119943 | A1 | 5/2011 | Arnold | 33/556 |
| 2011/0232117 | A1 | 9/2011 | Arnold | 33/555.1 |
| 2011/0239478 | A1 * | 10/2011 | Dall'Aglio et al. | 33/555.3 |

FOREIGN PATENT DOCUMENTS

| | | | |
|---|---|---|---|
| DE | 4412682 | | 10/1995 |
| DE | 4419656 | | 1/1996 |
| DE | 297 22 951 | U1 | 4/1998 |
| DE | 698 09 667 | T2 | 4/2003 |
| DE | 600 15 654 | T2 | 8/2005 |
| DE | 10 2008 016 228 | A1 | 10/2009 |
| EP | 0 068 082 | A2 | 1/1983 |
| EP | 0 322 120 | A2 | 6/1989 |
| EP | 0 382 336 | A2 | 8/1990 |
| EP | 0 469 439 | A1 | 2/1992 |
| EP | 0 480 222 | A2 | 4/1992 |
| EP | 0 810 067 | A1 | 12/1997 |
| EP | 0 859 689 | A1 | 8/1998 |
| EP | 0 859 689 | B1 | 8/1998 |
| EP | 0859689 | A | 8/1998 |
| EP | 0 878 704 | A1 | 11/1998 |
| EP | 0 903 199 | A2 | 3/1999 |
| EP | 1 063 052 | A2 | 12/2000 |
| EP | 1 063 052 | B1 | 12/2000 |
| EP | 1 118 833 | | 7/2001 |
| EP | 1 263 547 | B1 | 12/2002 |
| EP | 1 370 391 | | 11/2003 |
| EP | 1 370 391 | B1 | 12/2003 |
| EP | 1370391 | A | 12/2003 |
| EP | 1 263 547 | B1 | 12/2007 |
| FR | 756177 | | 9/1933 |
| GB | 405 817 | | 2/1934 |
| GB | 1361275 | | 7/1974 |
| GB | 1362996 | | 8/1974 |
| GB | 2086778 | A | 5/1982 |
| GB | 0105627 | | 4/1984 |
| GB | 2 161 101 | A | 8/1986 |
| GB | 2 197 477 | A | 5/1988 |
| GB | 2 300 582 | A | 11/1996 |
| JP | 53-4285 | A | 1/1978 |
| JP | 55-6825 | | 12/1979 |
| JP | 55120976 | | 9/1980 |
| JP | 55-156801 | | 12/1980 |
| JP | 59-93844 | U | 6/1984 |
| JP | 59125001 | | 7/1984 |
| JP | 3-66553 | A | 3/1991 |
| JP | 10-118974 | A | 5/1998 |
| JP | 11-513317 | A | 11/1999 |
| WO | WO 83/04302 | | 12/1983 |
| WO | WO 90/00246 | | 1/1990 |
| WO | WO 92/14120 | | 8/1992 |
| WO | WO 94/17361 | | 8/1994 |
| WO | WO 97/12724 | | 4/1997 |

| | | |
|---|---|---|
| WO | WO 97/13614 | 4/1997 |
| WO | WO 97/40434 | 10/1997 |
| WO | WO 99/47884 | 9/1999 |
| WO | WO 02/070195 | 9/2002 |
| WO | WO 02/090047 A1 | 11/2002 |

OTHER PUBLICATIONS

"Automatisierte Dreipunktmessung zur Rundheitsbestimmung an Kolbenbolzen", "Automated Three-Point Measurement for Determining Roundness on Piston Pins", Studienarbeit Jörg Seewig, Universität Hannover, Fachbereich Elektrotechnik, Dezember 1992.
EP0859689 A1 English language Abstract (1 pg.).
German Patent and Trademark Office (EPMA) Office Action in counterpart German priority application No. 10 2009 042, filed Sep. 22, 2009, dated Apr. 7, 2010 (3 pgs.).
Office Action in counterpart European patent application No. EP 10 00 9546 from European Patent Office (EPO), dated Nov. 2010 (4 pgs.).
Portion of Marposs Catalogue (circa 1970).
Leaflet—Fenar Marposs (1991).
"Crankshaft Gauging Machines," Hommelwerke (1985).
PCT Intl. Search Report for App. No. PCT/EP 00/128076 (mailed Feb. 26, 2003).
PCT Intl. Search Report for App. No. PCT/EP 01/00596 (mailed Jun. 15, 2001).
PCT Intl. Search Report for App. No. PCT/EP 02/02022 (mailed Jul. 9, 2002).
PCT Intl. Search Report for App. No. PCT/EP 02/04394 (mailed Sep. 27, 2002).
PCT Intl. Search Report for App. No. PCT/ 03/05740 (mailed Oct. 30, 2003.
PTO Communication Mailed Jan. 23, 2008 in Response to Suggestion of Interference Filed Feb. 28, 2008, 10 pages.
European Search Report in EP 11001656, dated Jun. 9, 2011 (3 pgs.).
German Search Report in DE 10 2010 013 069, dated Sep. 23, 2010 (3 pgs.).
Office Action dated Jan. 28, 2011 in German Application No. 10 2010 035 147.4, filed Aug. 23, 2010 (3 pgs.).
Zvi Drezner, On the circle closest to a set of points, 2002, Computers & Operations Research, 29, 637-650.
Curve fitting best practice, Part 3: Fitting data, 2008, IDBS Enabling Science.
Martin Marinov, Optimization methods for scattered data approximation with subdivision surfaces, Elsevier Science, Jul. 19, 2005.

* cited by examiner

MEASURING DEVICE

CROSS-REFERENCE TO RELATED APPLICATION

This application claims the priority of German application no. 10 2010 013 069.9-52, filed Mar. 26, 2010, and which is incorporated herein by reference.

FIELD OF THE INVENTION

The invention relates to a measuring device. More particularly, the invention relates to a measuring device for in-process measurement of test specimens during a machining process on a machine tool, in particular a machine tool such as a grinding machine.

BACKGROUND OF THE INVENTION

In the manufacture of crankshafts, the crank pins of the crankshaft must be ground to size on a grinding machine. To ensure that the grinding operation is ended as soon as a desired size is reached, it is necessary to continuously check the crank pin during the machining operation, in particular with regard to its diameter and roundness, within the scope of an in-process measurement method. EP-A-0859689 discloses a corresponding measuring device.

A measuring device is known from EP-A-1370391 which is used for in-process measurement of crank pins during a grinding operation on a grinding machine. The known measuring device has a measuring head which is connected via a rod assembly to a base body of the measuring device so as to be pivotable about a first pivot axis. The known measuring device also has a means for pivoting the measuring head in and out of the measuring position. For carrying out an in-process measurement of a crank pin, the measuring head is pivoted by the means provided for this purpose into a measuring position in which the measuring head, for example using a measuring prism, comes to rest against the crank pin to be measured. During the grinding operation the crank pin undergoes an orbital rotation about the rotational axis of the crankshaft. The grinding wheel remains in contact with the crank pin, and for this purpose is movably supported radially with respect to the rotational axis of the crankshaft. To ensure that measurements may be carried out at the crank pin during the entire grinding operation, the measuring head follows the motions of the crank pin. For this purpose the base body of the measuring device is connected to a base body of the grinding machine, so that during the grinding operation the measuring device is moved in the radial direction of the crankshaft, synchronously with the grinding wheel of the grinding machine.

A measuring device of this type is known which has a base body, and a measuring head which may be moved between a rest position and a measuring position. The known measuring device also has a means for moving the measuring head from the rest position into the measuring position, whereby this means may be formed in particular by a means for pivoting the measuring head. The known measuring device also has a stop for limiting the motion of the measuring head from the rest position into the measuring position.

OBJECTS AND SUMMARY OF THE INVENTION

An object of the invention is to overcome the drawbacks of the PRIOR ART measuring devices.

An object of the invention is to provide a measuring device, in particular for the in-process measurement of test pieces during a machining operation on a machine tool, in particular a grinding machine, whose operational reliability is increased.

Another object of the invention is to provide a measuring device, in particular for the in-process measurement of test pieces during a machining operation on a machine tool, in particular a grinding machine, whose operational reliability is increased, and which has a base body, and a measuring head which is movable between a rest position and a measuring position, and having an apparatus for moving the measuring head from the rest position into the measuring position, and having a stop for limiting the motion of the measuring head from the rest position into the measuring position, whose operational reliability is increased.

This object is achieved by the measuring device according to the invention, in particular for the in-process measurement of test pieces during a machining operation on a machine tool, in particular a grinding machine, the inventive measuring device including having a base body, a measuring head which is movable between a rest position and a measuring position, and an apparatus for moving the measuring head from the rest position into the measuring position. The inventive measuring device likewise includes a stop for limiting the motion of the measuring head from the rest position into the measuring position, a motorized drive unit which is operatively associated with the stop for adjusting the position of the stop in such a way that the measuring position is adjustable, and a control unit for activating the drive unit.

In practice, measuring devices of this type are used, for example and in particular, for checking the dimensional accuracy of crank pins of a crankshaft within the scope of an in-process measurement during a machining operation on a grinding machine. The same measuring device is used to measure crankshafts having different dimensions and to measure different diameters of the crank pins thereof. For adjusting the measuring device to crank pins of different diameters, it may be necessary to adjust the position of the stop, resulting in different measuring positions for crank pins of different diameters. The invention is based on the concept of configuring the measuring device in such a way that the stop is displaced in a particularly simple and reliable manner.

To this end, the invention provides that a motorized drive unit is associated with the stop for adjusting the position of the stop in such a way that the measuring position is adjustable, and a control unit for activating the drive unit is associated with the drive unit. According to the invention, the position of the stop is thus adjusted in a motorized manner via the control by the control unit. In this manner the risk of faulty adjustments is significantly reduced as compared to manually adjusting the position of the stop.

If, for example, different measuring prisms are used for measuring crank pins of different diameters, a measuring position, that is, a position in which the motion of the measuring head is limited by the stop, and therefore a predetermined position of the stop, may be associated with each measuring prism. After a changing of the measuring prism, according to the invention the adjustment of the position of the stop, and thus of the measuring position, may then be carried out in a semi-automatic or completely automatic manner. The operation of the measuring device according to the invention is thus greatly simplified. In this way, complicated manual adjustments are completely or largely dispensed with.

The invention thus improves the operational reliability and handling of the measuring device according to the invention in a surprisingly simple manner.

In principle, the motorized drive unit may be configured in any desirable manner, for example as a hydraulic or pneumatic drive. In order to configure the measuring device according to the invention in a particularly simple and inexpensive as well as operationally reliable manner, one advantageous embodiment of the invention provides that the drive unit is configured as a drive unit that is operated by an electric motor. Suitable motors are available as relatively simple, inexpensive, and robust standard components.

Another advantageous embodiment of the invention provides that the control unit is configured for automatic or semi-automatic activation of the drive unit. For an automatic or completely automatic activation of the drive unit, respectively, for example, a means may be provided which, after a changing of the measuring prism, recognizes which prism is installed and transmits the appropriate information to the control unit. The control unit is then able to set the associated position of the stop. For example, a radio frequency identification (RFID) chip may be associated with each measuring prism, in this case the control unit having an RFID reader. After a prism is installed, the control unit automatically recognizes which prism has been installed. On this basis, the stop may then be controlled by the control unit to move into the required position in a completely automatic manner. In such an embodiment, a changing of the measuring prism automatically results in a corresponding adjustment of stop, and thus to a displacement of the measuring position. However, according to the invention it is also possible to configure a semi-automatic activation of the drive unit. In this embodiment, for example after a changing of the measuring prism by a user, an indication is provided as to which measuring prism is involved. On this basis the control unit controls the stop to move into the associated position.

For semi-automatic activation of the drive unit, it is advantageous for an input unit to be associated with the control unit for inputting the position of the stop to be adjusted. The input unit may be configured as a keyboard or touchscreen, for example. The position of the stop to be adjusted may be entered directly by the user. However, the position may also be entered indirectly, in that the user indicates, for example, the diameter of a crank pin to be measured, and on this basis the control unit determines the required position of the stop and appropriately activates the drive unit.

Another advantageous embodiment of the invention provides that the means for moving the measuring head between the rest position and the measuring position has a rod assembly via which the measuring head is connected or connectable to a part of the machine tool, in particular to a carriage of a grinding machine.

If the measuring device is used, for example, to measure a crank pin of a crankshaft which undergoes an orbital rotation about the rotational axis of the crankshaft during a machining operation on a grinding machine, in the previously mentioned embodiment it is advantageous for the rod assembly to be configured in such a way that the measuring head follows an orbital rotation of the test piece about an axis during the machining operation. In this manner, during the machining operation the measuring head may remain in continuous contact with the test piece which is undergoing an orbital rotation, so that the particular measuring task may be carried out continuously.

Another advantageous embodiment provides that the measuring head has a measuring probe and a measuring prism. According to the invention, a measuring prism is understood to mean a device which establishes a defined contact with the test piece, so that output signals of the measuring probe operating according to the scanner principle may be used to draw conclusions concerning, for example, the roundness and/or dimensions of a test piece.

The measuring device is advantageously a roundness and/or dimension measuring device for measuring the roundness and/or dimensions, in particular a diameter, in particular of a crank pin of a crankshaft, as provided in another advantageous embodiment. In this embodiment, the measuring probe is in signal transmission connection with a downstream evaluation unit which evaluates the output signals of the measuring probe in such a way that conclusions may be drawn concerning the roundness and/or dimensions of a test piece, in particular of a crank pin of a crankshaft.

A machine tool according to the invention, in particular a grinding machine, which is provided with at least one of the measuring devices set forth herein.

According to the invention, the position of the stop may be adjusted in a stepless manner. However, according to the invention it is also advantageous for the position of the stop to result from discrete steps having a predefined increment.

Another embodiment of the invention provides that the drive unit has at least one linear drive. Appropriate linear drives are available as simple and relatively inexpensive standard components.

According to the invention, pivoting in and out refers to a motion of the measuring head between its rest position and a measuring position in which the measuring head rests against the test piece to be measured, independently of the trajectory described by the measuring head in its motion between the rest position and the measuring position. In particular, the measuring head may move along any desired, for example parabolic, trajectory between its rest position and its measuring position. The measuring device according to the invention is particularly well suited for the in-process measurement of test pieces during a machining operation on a machine tool. However, the measuring according to the invention device is also suitable for carrying out measurements outside a machining operation.

The invention is explained in greater detail below with reference to the accompanying highly schematic drawings which illustrate one embodiment of a measuring device according to the invention. In this regard, all features that are described, illustrated in the drawings, and claimed in the claims constitute the subject matter of the invention, taken alone or in any desired combination, independently of their combination in the claims and their dependencies, and independently of their description or illustration in the drawings.

Relative terms such as in, out, up, and down are for convenience only and are not intended to be limiting.

DETAILED DESCRIPTION OF THE INVENTION

Figure 1:
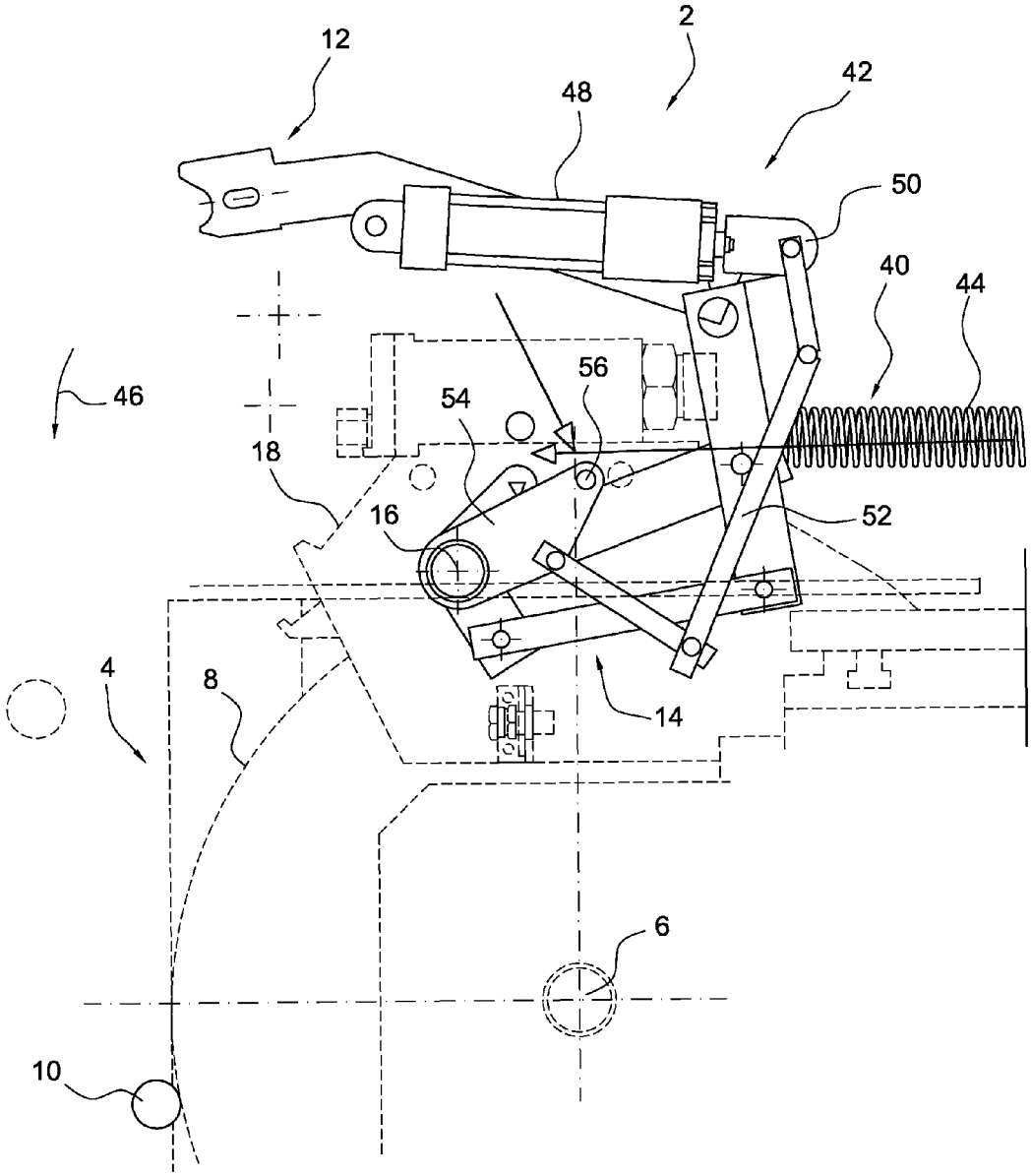
FIG. 1 shows in a highly schematic illustration a side view of an embodiment of a measuring device according to the invention in a rest position of the measuring head.

FIG. 1 shows an embodiment of a measuring device 2 according to the invention which is used for the in-process measurement of test pieces during a machining operation on a grinding machine 4. The grinding machine 4, which for simplicity is only partially illustrated, has a grinding wheel 8 which is rotatable about a rotational axis 6 fixed to the machine, and which is used for machining a test piece, which in the present embodiment is formed by a crank pin 10 of a crankshaft.

The measuring device 2 has a measuring head 12 which is connected via a rod assembly or linkage 14 to a base body 18 of the measuring device 2 so as to be pivotable about a first pivot axis 16.

The measuring device 2 also has a means for pivoting the measuring head 12 in or out of the measuring position, as explained in greater detail below.

Figure 2A:
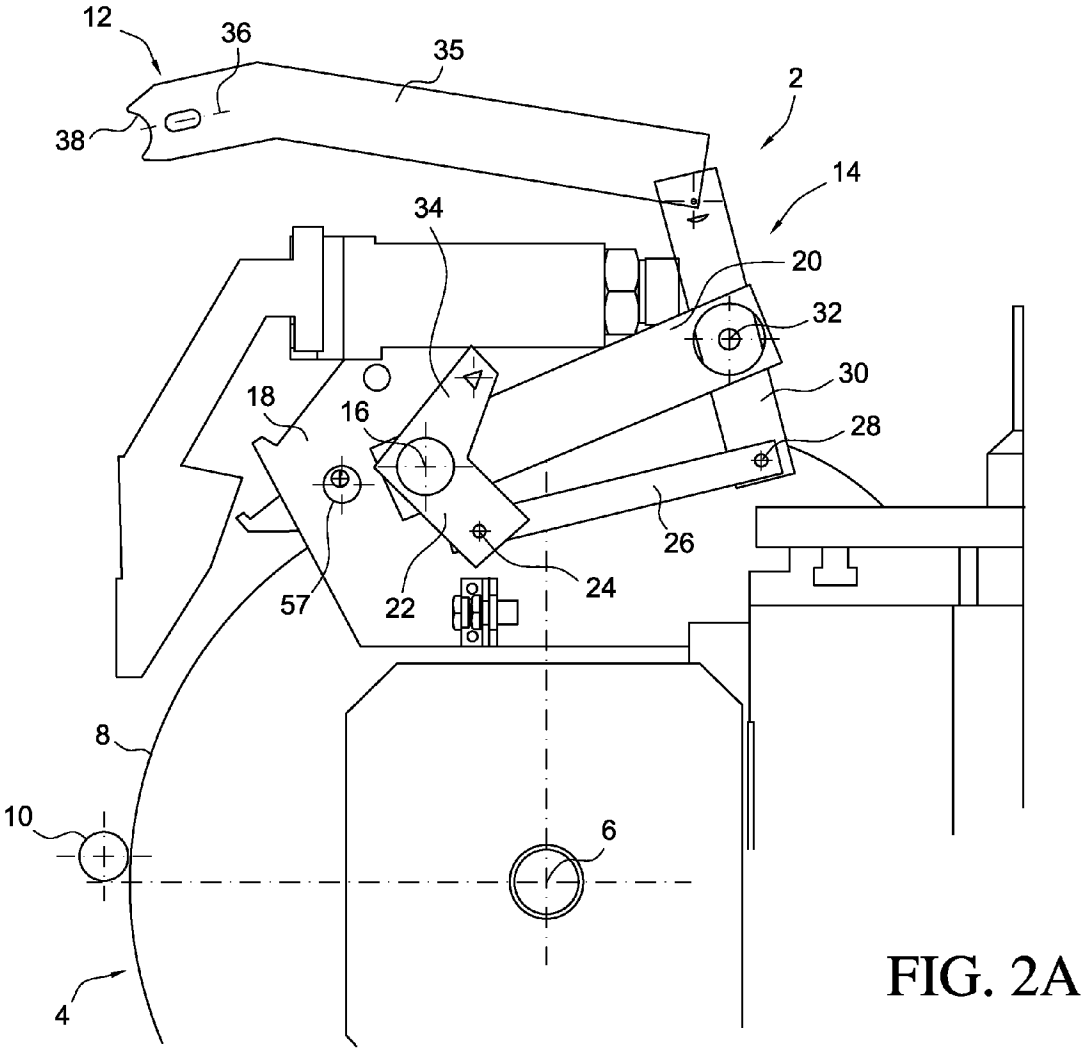
FIG. 2A through 2E show the measuring device according to FIG. 1 in various kinematic phases.

First, the configuration of the rod assembly or linkage 14 is explained in greater detail with reference to FIG. 2A. In FIG. 2A-2E, the means for pivoting the measuring head 12 in or out of the measuring position is omitted for the sake of clarity. The linkage 14 has a first rod assembly element or first linkage element 20 and a second rod assembly or linkage element 22 which are mounted so as to be pivotable about the first pivot axis 16. At the end of the second rod assembly element 22 facing away from the first pivot axis 16, a third rod assembly or linkage element 26 is connected which is pivotable about a second pivot axis 24, and whose end facing away from the second pivot axis 24 is connected to a fourth rod assembly or linkage element so as to be pivotable about a third pivot axis 28, the fourth rod assembly element being connected to the first rod assembly element 20, at a distance from the third pivot axis 28, so as to be pivotable about a fourth pivot axis.

In the illustrated embodiment, the first rod assembly element 20 and the third rod assembly element 26 are provided in a nonparallel manner with respect to one another, the distance between the first pivot axis 16 and the second pivot axis 24 being smaller than the distance between the third pivot axis 28 and the fourth pivot axis 32.

In the illustrated embodiment, the second rod assembly element 22 has a lever arm 34 such that the lever arm 34 together with the rod assembly element 22 forms a two-armed angle lever, whose function is explained in greater detail below.

In this embodiment, the measuring head 12 is provided on a holding arm 35 which is connected to the fourth rod assembly element 30 extending past the fourth pivot axis 32. In the illustrated embodiment, the connection between the holding arm 34 and the fourth rod assembly element 30 has a rigid configuration. It is apparent from FIG. 2A that in the illustrated embodiment a free end of the holding arm 34 which supports the measuring head 12 is angled toward the first pivot axis 16, wherein a portion of the holding arm 34 connected to the fourth rod assembly element 30 together with the fourth rod assembly element 30 define an angle greater than 90°.

In the illustrated embodiment, the measuring head 12 has a linearly deflectable measuring probe 36, indicated by a dashed line in FIG. 2A. In the illustrated embodiment the measuring head 12 also has a measuring prism 38. The manner in which roundness and/or dimension measurements are performed on a test piece, in particular a crank pin of a crankshaft or another cylindrical component, using a system composed of a linearly deflectable measuring probe 36 and a measuring prism 38, is generally known to one skilled in the art and therefore is not explained in greater detail herein.

The measuring device 2 also has a means for moving the measuring head 12 from a rest position into the measuring position, which in the present embodiment has a means for pivoting the measuring head 12 in and out which engages with the rod assembly 14, as explained in greater detail with reference to FIG. 1. In the illustrated embodiment, the means for pivoting the measuring head 12 in and out has a pivot-in device 40 and a separate pivot-out device 42.

In the illustrated embodiment, the pivot-in device 40 has a spring means, which in the present embodiment includes a spring 44, configured as a compression spring, which acts on the measuring head 12 via the rod assembly 14 in a pivot-in direction represented by an arrow 46 in FIG. 1. In the present embodiment, the spring 44 is configured as a compression spring, and at one end is supported on the base body 18 of the measuring device 2 and at the other end is supported on the lever arm 34, so that the spring 44 acts on the lever arm 34 in the counterclockwise direction in FIG. 1, and thus tends to move the measuring head 12 in the pivot-in direction 46 by means of the rod assembly 14.

The pivot-out device 42 in this embodiment has a hydraulic cylinder 48, the piston of which is connected at its free end to the base body 18 of the measuring device 2. The piston rod 50 of the hydraulic cylinder 48 is connected to a lever system 42, in the present embodiment configured as a toggle lever, the free end of which facing away from the piston rod 50 is connected to a one-armed lever 54, which is supported coaxially with the pivot axis 16, in an eccentric manner with respect to the first pivot axis 16. At its free end the lever 54 has a journal 56, which extends into the plane of the drawing, and which loosely acts on the first rod assembly element 20, so that for a motion in a pivot-out direction which corresponds to a clockwise motion in the drawing, the lever 54 functions as a carrier for the first rod assembly element 20.

For sensing the particular position of the measuring head 12, a sensor means is provided which is in operative connection with a control means for controlling the pivot-in device 40 and the pivot-out device 42.

Measured values which are recorded by the measuring probe 36 during a measuring operation are evaluated using an evaluation computer. The manner in which corresponding measured values are evaluated is generally known to one skilled in the art and therefore is not explained in greater detail herein.

The mode of functioning of the measuring device 2 according to the invention is as follows:

In the rest position illustrated in FIG. 1 and FIG. 2A, the measuring head 12 is disengaged from the crank pin 10. In this rest position the hydraulic cylinder 48 is stopped, thus blocking a motion of the lever arm 34 in the counterclockwise direction in FIG. 1, which the compression spring 44 tends to bring about.

For pivoting the measuring head 12 in the pivot-in direction 46, the hydraulic cylinder 48 is activated in such a way that its piston rod 50 travels to the right in FIG. 1. When the piston rod 50 is extended, the spring 44 presses against the lever arm 34, so that the lever arm 34 is pivoted in the counterclockwise direction in FIG. 2. Since the lever arm 34 is connected to the second rod assembly element 22 in a rotationally fixed manner, the second rod assembly element 22 and therefore the entire rod assembly 14 is pivoted in the counterclockwise direction in FIG. 2.

Figure 2B:
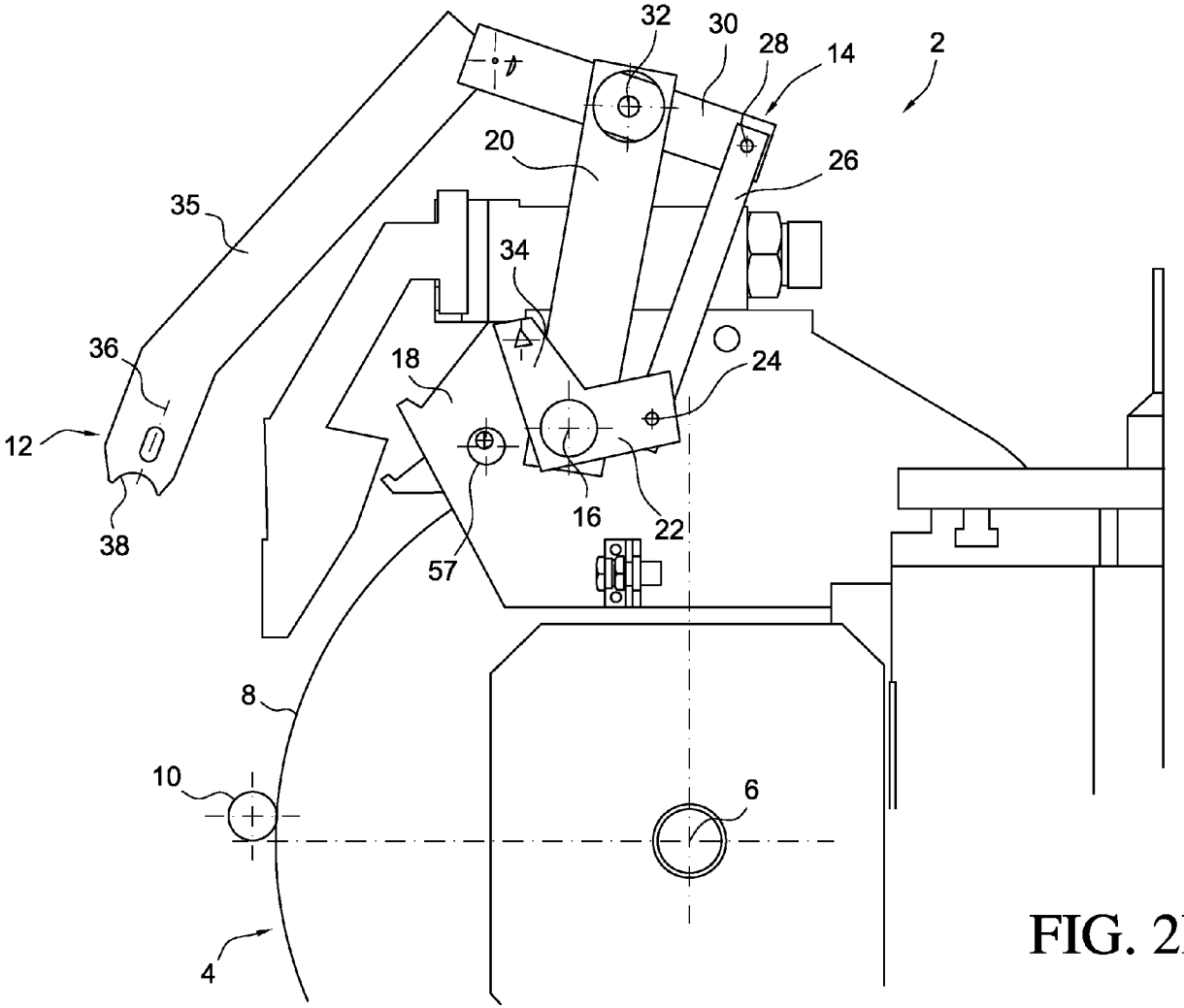

FIG. 2B shows the measuring head 12 in a position between the rest position and the measuring position.

Figure 2C:
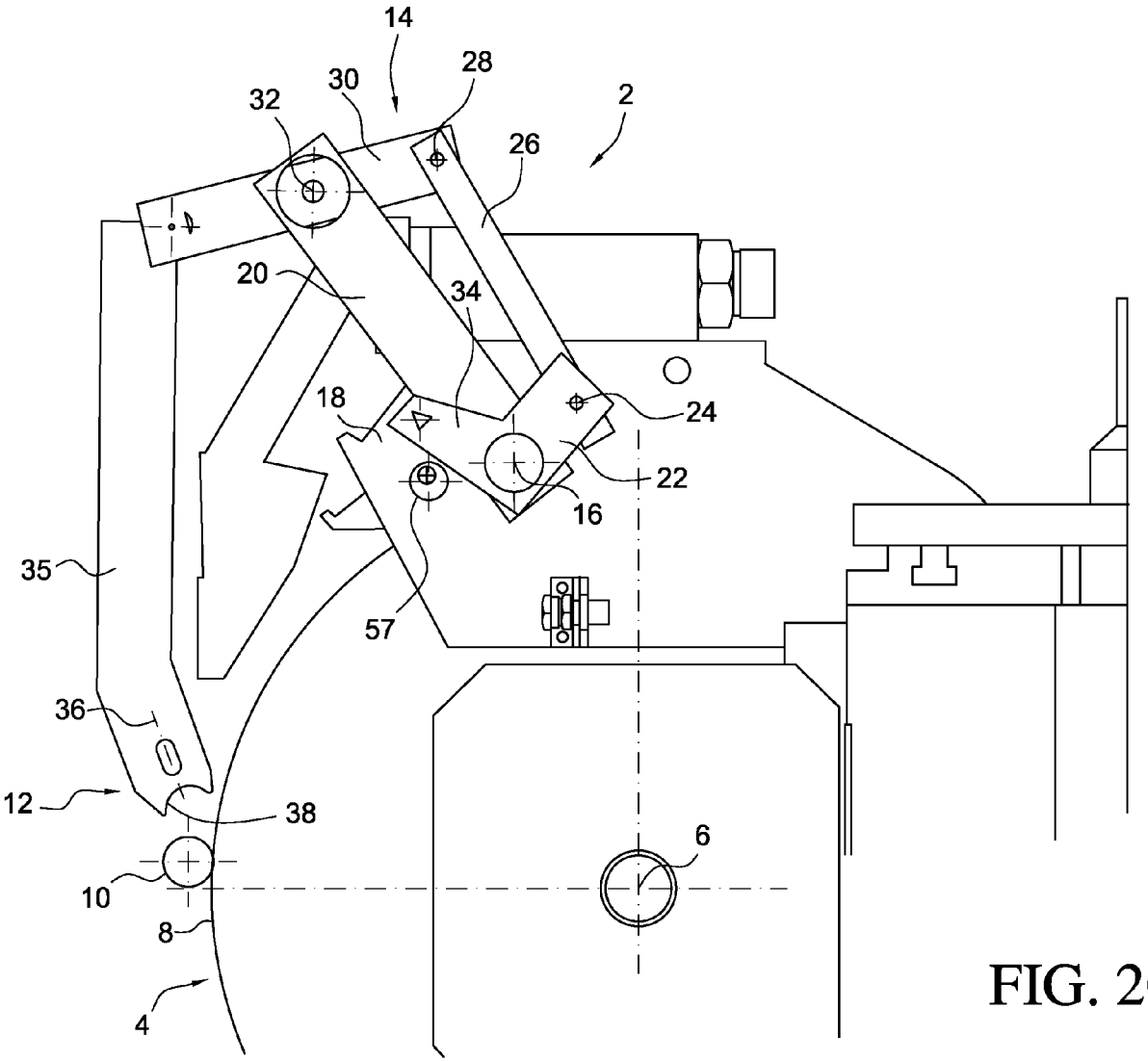

When a predetermined angular position illustrated in FIG. 2C is reached, the lever arm 34 strikes a stop 57; when the lever arm 34 strikes the stop 57 a control signal is transmitted to the control means, causing the hydraulic cylinder 48 to stop. FIG. 2C shows the measuring head 12 in a search position in which it is not yet in contact with the crank pin 10.

Figure 2D:
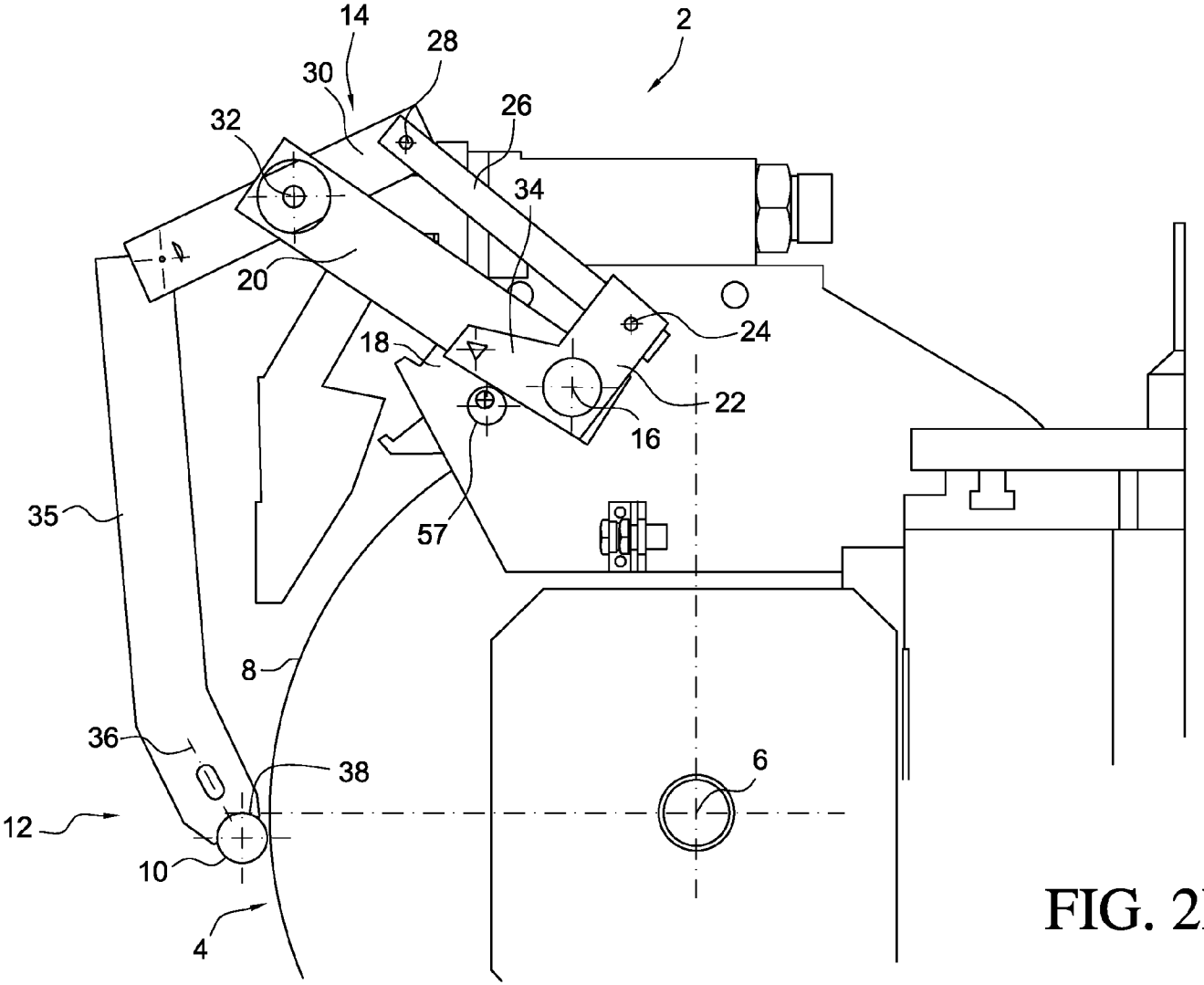

FIG. 2D shows the measuring head 12 in its measuring position, in which it is in contact with the crank pin 10.

Figure 2E:
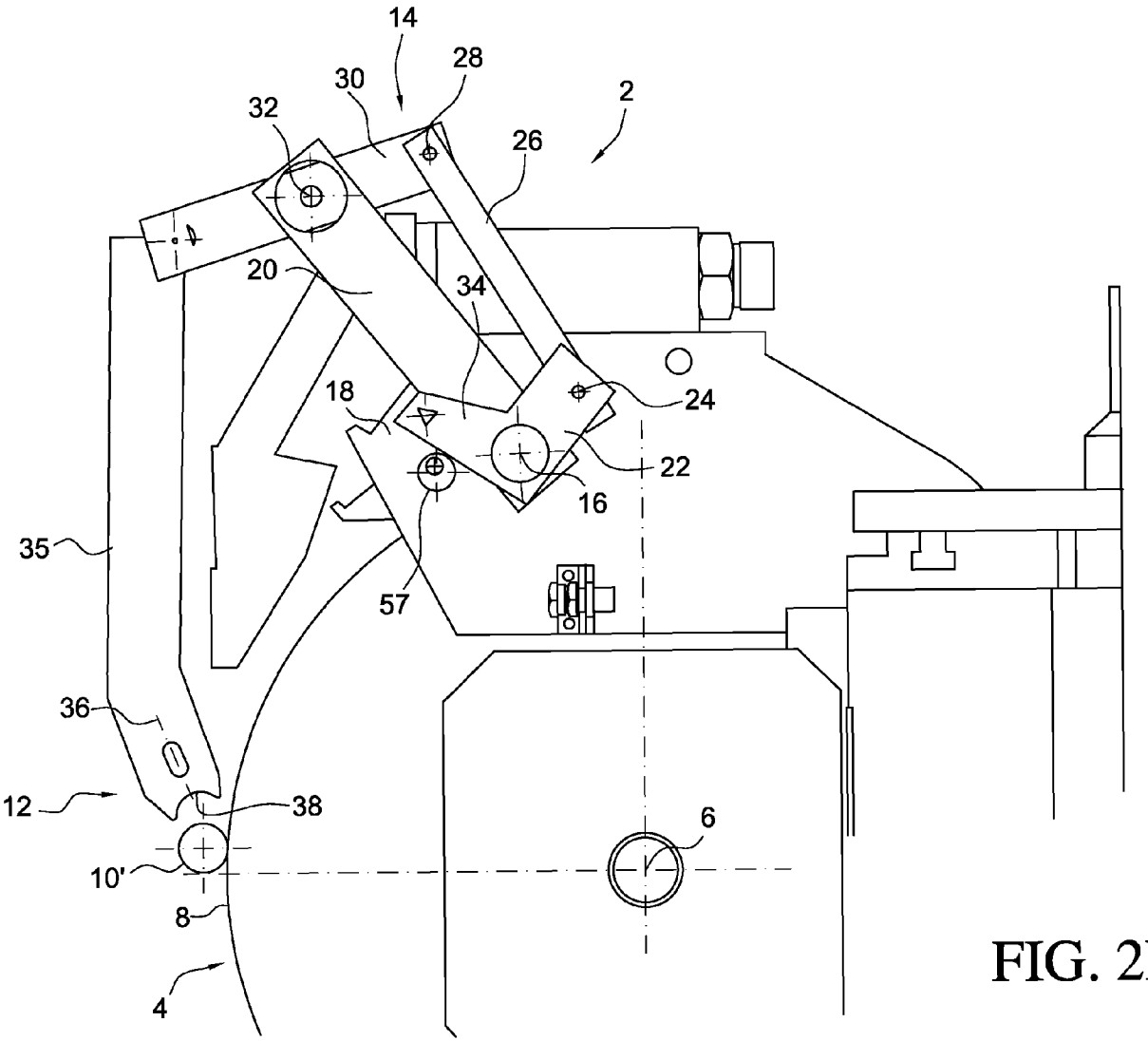

FIG. 2E corresponds to FIG. 2C, the measuring head 12 being illustrated in its search position with respect to a crank pin 10' of larger diameter.

Figure 3:
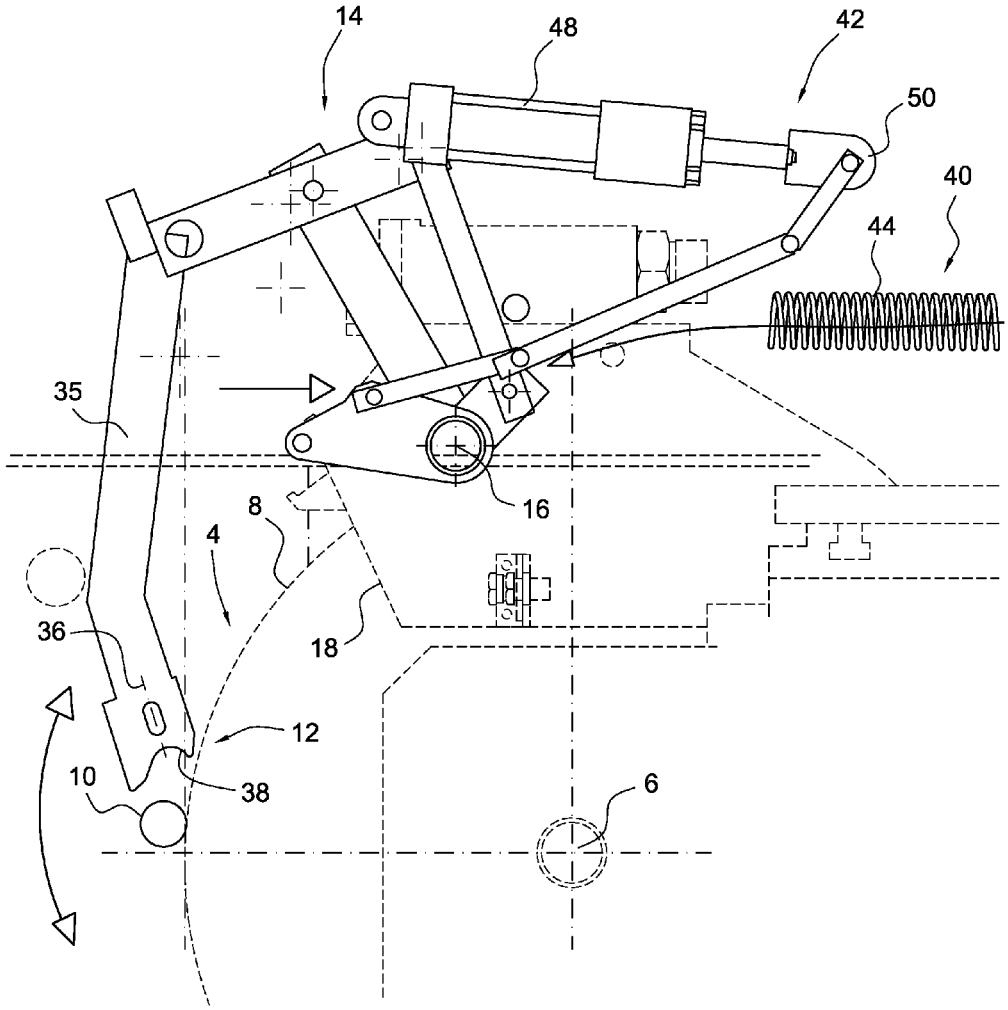
FIG. 3 shows, in the same illustration as FIG. 1, the embodiment according to FIG. 1 during the motion of the measuring head into the measuring position.

FIG. 3 shows the measuring device 2 in the search position of the measuring head 12, which is also illustrated in FIG. 2C. It is apparent from a comparison of FIG. 1 and FIG. 3 that the lever 54 is pivoted in the counterclockwise direction in FIG. 1 by means of the lever system 42 when the piston rod 50 of the hydraulic cylinder 48 is extended, until the angular position of the lever 54 illustrated in FIG. 3 is reached. As shown in FIG. 3, in this angular position the journal 56 is provided at a distance from the first rod assembly element 20 in the circumferential direction of the first rotational axis 16, so that the first rod assembly element 20 and therefore the entire rod assembly 14 is able to move freely under the effect of the weight of the measuring head 12, including the holding arm 34, and the pressure force exerted by the spring 44. In the measuring position (see FIG. 2D) the measuring head 12 contacts the crank pin 10, the measuring head following orbital rotations of the crank pin 10 about the crankshaft during the grinding operation. For this purpose, the base body 18 of the measuring device 2 is connected to a mounting of the grinding wheel 8, in particular to a carriage of the grinding machine, in a fixed manner so that the measuring device 2 follows translatory motions of the grinding wheel 8 in the radial direction of the rotational axis 6.

During the contact of the measuring head 12 with the crank pin 10 the measuring probe 36 records measured values, on the basis of which the roundness and/or the diameter of the crank pin may be assessed in the evaluation computer downstream from the measuring probe 36. When, for example, a specified size of the diameter is reached, the grinding wheel 8 is disengaged from the crank pin 10.

In order to pivot out the measuring head 12 in the direction opposite the pivot-in direction 46 when the measurement is completed, the control unit activates the hydraulic cylinder 48 in such a way that the piston rod 50 thereof moves to the left in FIG. 3. This causes the lever 54 to be pivoted in the clockwise direction in FIG. 3 by means of the lever system 42. As long as the roller 56 is provided at a distance from the rod assembly element 20 in the circumferential direction of the first pivot axis 16, the measuring head 12 initially remains in the measuring position. When the roller 56 comes into contact with the first rod assembly element 20 upon further pivoting of the lever 54 in the clockwise direction in FIG. 3 about the pivot axis 16, the lever 54 functions as a carrier upon further pivoting in the clockwise direction and carries the first rod assembly element 20, and therefore the entire rod assembly 14, in the clockwise direction, so that the measuring head is pivoted out in the direction opposite the pivot-in direction 46 until the rest position illustrated in FIG. 1 is reached.

During the measuring operation, the measuring head moves in the circumferential direction of the crank pin 10 with an angular stroke, which angular stroke in the illustrated embodiment is about −7° and +5°, i.e., 12° total.

According to the invention, a motorized drive unit 80 (see FIG. 4) is operatively associated with the stop 57 for adjusting the position of the stop 57 in such a way that the measuring position is adjustable. In the context of the present invention, the measuring position is understood to mean the position in which the lever arm 34 comes to rest against the stop 57, independently from the motion of the measuring head 12 together with the crank pin 10 after it engages with the crank pin.

Figure 4A:
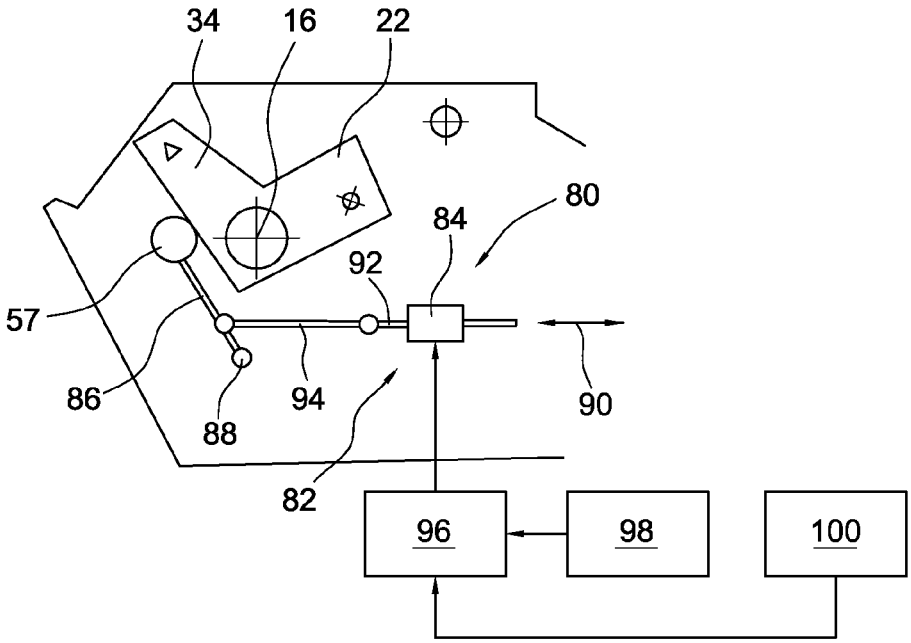
FIGS. 4A and 4B show in a highly schematic illustration a first embodiment of a motorized drive unit according to the invention for adjusting the position of the stop in two positions of the stop.

In the embodiment illustrated in FIG. 4, the drive unit is configured as a drive unit operated by an electric motor, and has a linear drive 82 having an electric motor 84. In the illustrated embodiment the stop 57 is connected to one end of a one-armed lever 86, the other end of which is mounted so as to be pivotable about a pivot axis 88. Thus, in the present embodiment the position of the stop 57 is adjusted by pivoting the lever 86. For this purpose an output element 92, which is linearly movable along a double arrow 90, is articulatedly connected to one end of a rod 94, the other end of which is articulatedly connected to the lever 86 at a distance from the pivot axis 88 and the stop 57. When the output element 92 of the linear drive 82 moves to the left in FIG. 4A, the lever 86 pivots about the pivot axis 88 in the counterclockwise direction in FIG. 4A, thus changing the position of the stop 57.

For activating the drive unit 80, a control unit 96 is provided which may be in the form of a control computer, for example. In the illustrated embodiment, an input unit 98 which is used by an operator of the measuring device 2 to manually enter the position of the stop 57 to be adjusted is associated on the one hand with the control unit 96.

If it is necessary to adjust the position of the stop 57, the operator enters the desired or required position of the stop 57 via the input unit 98. The control unit then activates the drive unit 80 in such a way that the stop 57 is moved into the selected position. It may be necessary to adjust the position of the stop 57, for example, when a crank pin 10 having a larger diameter than that in FIG. 2A is to be measured, and in particular a larger measuring prism 38 is used for this purpose. In such a case, the position of the stop 57 may be adjusted by the operator, for example by entering the diameter of the crank pin to be measured or an identifier for the measuring prism 38 used. The control unit 96 then converts the diameter of the crank pin or the identifier for the measuring prism 38 to the associated position of the stop 57 and appropriately activates the drive unit 80. In this regard, the position of the stop 57 is adjusted semi-automatically.

In order to automatically adjust the position of the stop 57, in the illustrated embodiment the control unit 96 is connected to an RFID reader, an RFID chip being associated with each measuring prism 38 used in conjunction with the measuring device 2. The RFID reader reads, when the measuring device 2 is started, for example, the RFID chip associated with the measuring prism 38 used, and transmits the associated data to the control unit 96, which determines the required position of the stop 57 and correspondingly activates the drive unit.

Figure 4B:
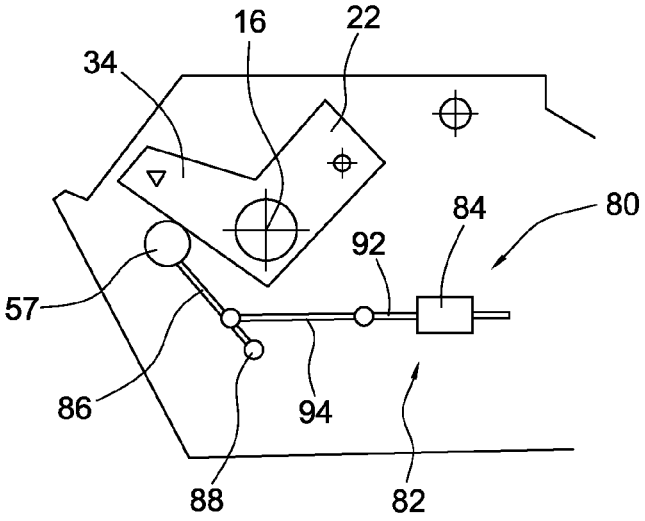
Figure 5A:
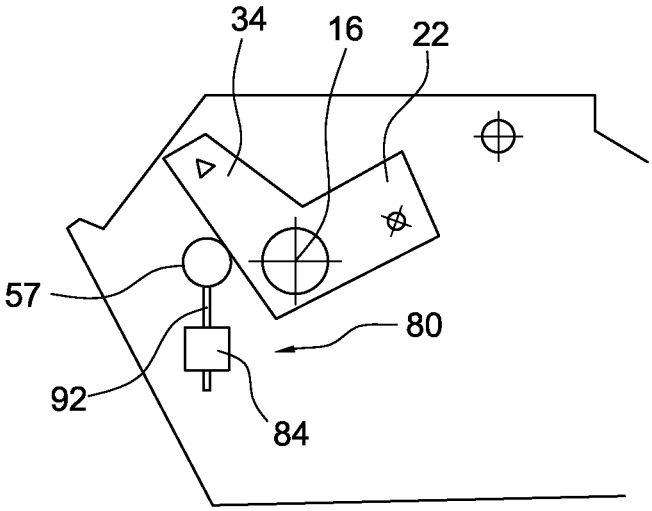
FIGS. 5A and 5B show, in the same illustration as FIG. 4, a second embodiment of a motorized drive unit.
Figure 5B:
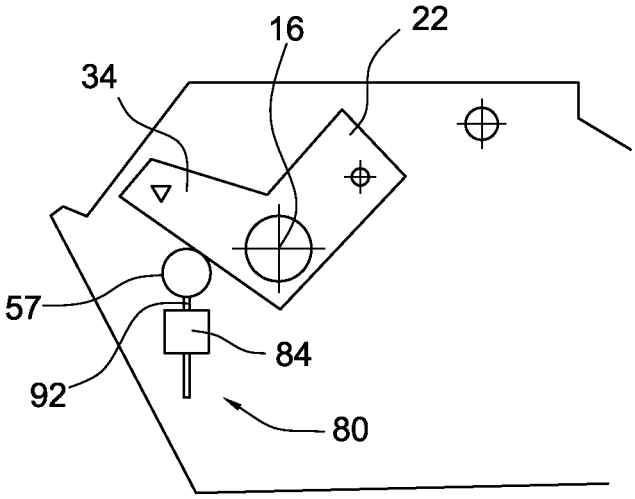

For the sake of clarity, the control unit 96, the input unit 98, and the RFID reader have been omitted in FIGS. 4B, 5A, and 5B.

FIG. 4B shows the stop 57 in a position that is shifted with respect to FIG. 4A, with the lever 86 pivoted in the counterclockwise direction with respect to FIG. 4A, so that when the measuring head 12 pivots in, the lever arm 34 correspondingly comes to rest against the stop 57 at a later time.

FIG. 5A shows a second embodiment of a drive unit 80 used according to the invention, which differs from the embodiment according to FIG. 4A in that the stop 57 is provided directly at the output element 92 of the linear drive 82. Thus, in the embodiment according to FIG. 5A the stop 57 is not pivoted, and instead is linearly displaced along the linear displacement axis of the output element 92, and in the illustrated embodiment is displaced in height.

FIG. 5B shows the embodiment according to FIG. 5A in a position in which the stop 57 is shifted downward in the drawing compared to FIG. 5A, so that in comparison to FIG. 5A the lever arm 34 comes to rest against the stop 57 at a correspondingly later time.

The invention greatly increases the operational reliability of the measuring device 2 according to the invention, and is configured to make operation simpler and less time-consuming.

Identical or corresponding components are provided with the same reference numerals in the figures of the drawing. FIGS. 2A through 2E show a variant which has a slightly modified configuration with respect to the embodiment according to FIG. 1 and FIG. 3, which, however, is consistent with the embodiment according to FIG. 1 and FIG. 3 with regard to the basic principle of the invention.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention.

What is claimed is:

1. Measuring device for the in-process measurement of test pieces during a machining operation on a machine tool and having a base body, comprising:

a) a measuring head which is movable between a rest position and a measuring position;

b) an apparatus for moving the measuring head from the rest position into the measuring position;

c) a stop for limiting the motion of the measuring head from the rest position into the measuring position;

d) a motorized drive unit which is operatively associated with the stop for adjusting the position of the stop in such a way that the measuring position is adjustable; and e) a control unit for activating the drive unit.

2. Measuring device according to claim 1, wherein:

a) the drive unit is configured as a drive unit that includes an electric motor.

3. Measuring device according to claim 1, wherein:

a) the control unit is configured for automatic or semi-automatic activation of the drive unit.

4. Measuring device according to claim 1, wherein:

a) an input unit is associated with the control unit for entering the adjustment position of the stop.

5. Measuring device according to claim 1, wherein:

a) the drive unit includes at least one linear drive.

6. Measuring device according to claim 1, wherein:

a) the apparatus for moving the measuring head between the rest position and the measuring position includes a linkage by which the measuring head is one of connected and connectable to a part of the machine tool.

7. Measuring device according to claim 6, wherein:

a) the linkage is configured in such a way that the measuring head follows an orbital rotation of the test piece about an axis during the machining operation.

8. Measuring device according to 1, wherein:

a) the measuring head includes a measuring probe and a measuring prism.

9. Measuring device according to 1, wherein:

a) the apparatus for moving the measuring head between the rest position and the measuring position includes a linkage by which the measuring head is one of connected and connectable to a carriage of a grinding machine.

10. Measuring device according to claim 1, wherein:

a) the measuring device is configured as one of a roundness and dimension measuring device for measuring one of the roundness, dimensions, and a diameter of a test piece.

11. Measuring device according to claim 1, wherein:

a) the measuring device is configured as one of a roundness and dimension measuring device for measuring one of the roundness, dimensions, and a diameter of a crank pin of a crankshaft.

12. Measuring device according to claim 1, wherein:

a) the machine tool includes a grinding machine.

* * * * *